US007321204B2

(12) United States Patent
Park et al.

(10) Patent No.: US 7,321,204 B2
(45) Date of Patent: Jan. 22, 2008

(54) BULB STRUCTURE AND MANUFACTURING METHOD OF ELECTRODELESS LIGHTING SYSTEM

(75) Inventors: Byeong-Ju Park, Seoul (KR); Yun-Chul Jung, Gyeonggi-Do (KR); Joon-Sik Choi, Seoul (KR); Yong-Seog Jeon, Gyeonggi-Do (KR); Hyun-Jung Kim, Seoul (KR); Ji-Young Lee, Gyeonggi-Do (KR); Seung-Yeup Hyun, Seoul (KR); Dae-Kyung Kim, Seoul (KR); Ri-Na Hwang, Seoul (KR)

(73) Assignee: LG Electronics, Inc., Seoul (KR)

( * ) Notice: Subject to any disclaimer, the term of this patent is extended or adjusted under 35 U.S.C. 154(b) by 6 days.

(21) Appl. No.: 11/029,421

(22) Filed: Jan. 6, 2005

(65) Prior Publication Data

US 2006/0087256 A1 Apr. 27, 2006

(30) Foreign Application Priority Data

Oct. 26, 2004 (KR) ..... 10-2004-0085952

(51) Int. Cl.
*H01J 19/80* (2006.01)

(52) U.S. Cl. ..... 315/248; 315/39

(58) Field of Classification Search ..... 315/248, 315/39, 246; 313/24

See application file for complete search history.

(56) References Cited

U.S. PATENT DOCUMENTS 5,977,724 A * 11/1999 Dolan et al. ..... 315/248
6,744,221 B2 * 6/2004 Choi et al. ..... 315/248
6,815,896 B2 * 11/2004 Kang ..... 315/39
2002/0030453 A1 * 3/2002 Kirkpatrick et al. ..... 315/248
2002/0089287 A1 * 7/2002 Kim et al. ..... 315/39
2002/0101191 A1 * 8/2002 Dolan et al. ..... 315/248
2002/0167282 A1 * 11/2002 Kirkpatrick et al. ..... 315/248
2003/0057841 A1 * 3/2003 Kang ..... 315/39
2003/0057842 A1 * 3/2003 Kim et al. ..... 315/39
2003/0132719 A1 * 7/2003 Choi et al. ..... 315/248
2003/0160553 A1 * 8/2003 Seo ..... 313/24
2004/0120147 A1 6/2004 Jeon et al.

FOREIGN PATENT DOCUMENTS

KR 2003-0028187 4/2003

OTHER PUBLICATIONS

U.S. Appl. No. 11/029,373 to Choi et al., filed Jan. 6, 2005.
U.S. Appl. No. 11/037,016 to Kim et al., filed Jan. 19, 2005.

* cited by examiner

*Primary Examiner*—Tim Vo
*Assistant Examiner*—Hung Tran Vy
(74) *Attorney, Agent, or Firm*—Greenblum & Bernstein, P.L.C.

(57) ABSTRACT

A bulb structure of an electrodeless lighting system comprises: a bulb body having an interior space receiving a luminous material emitting light by microwave energy; a bulb support portion integrally extending from one side of the bulb body to communicate with the bulb body, supporting the bulb body, connected to a bulb rotating motor at its one end, and having therein a passage through which the luminous material is injected; and a covering portion formed at an inner communicating portion where the bulb body communicates with the bulb support portion so as to hermetically seal the bulb body, thereby improving light distribution characteristics of the electrodeless lighting system.

12 Claims, 5 Drawing Sheets

BULB STRUCTURE AND MANUFACTURING METHOD OF ELECTRODELESS LIGHTING SYSTEM

BACKGROUND OF THE INVENTION

1. Field of the Invention

The present invention relates to a bulb of an electrodeless lighting system, and particularly, to a bulb structure and a manufacturing method of an electrodeless lighting system configured to improve light distribution characteristics.

2. Description of the Background Art

In general, an electrodeless lighting system is an apparatus emitting visible light or ultraviolet light from an electrodeless plasma bulb upon applying microwave energy to the bulb. The electrodeless lighting system has a long life span and good lighting effect compared with an incandescent lamp or a fluorescent lamp which is generally used.

FIG. 1 is a longitudinal sectional view showing one example of a conventional electrodeless lighting system.

As shown, the conventional electrodeless lighting system using microwave energy includes: a case 1 forming a certain interior space; a microwave generator 2 mounted in the case 1, for generating microwave energy; a waveguide 4 for guiding microwave energy generated from the microwave generator 2; a resonator 4 installed at an exit portion 4*a* of the waveguide 4, communicating therewith; and a bulb 5 positioned in the resonator 6, for generating light as a filling material becomes a plasma by the microwave energy transferred through the waveguide 4.

In addition, a reflecting mirror 7 for concentratively reflecting light generated from the bulb 5 to the front is provided in front of the case 1, namely, at a surrounding area of the resonator 6.

Undescribed reference mark 12 is a bulb motor for rotating the bulb 5, and 12*a* is a bulb motor rotating shaft.

The bulb 5 includes; a bulb body 5*a* having a certain interior space and formed as a spherical shape; and a bulb rotating shaft 5*b* extending from the bulb body 5*a* and coaxially coupled to the bulb motor rotating shaft 12*a*, for serving as a medium for rotation of the bulb body 5*a* according to the rotation of the bulb motor 12.

FIG. 2 shows a manufacturing method of a bulb of the conventional electrodeless lighting system, and FIG. 3 shows a bulb structure of the conventional electrodeless lighting system.

As shown in FIG. 2, a hollow pipe 8 communicating with an interior space of the bulb body 5*a* is formed at one side of the bulb body 5*a*, the opposite side of the bulb rotating shaft 5*b*.

A luminous material 9 is injected into the interior space of the bulb body 5*a* through the hollow pipe 8. After a proper amount of luminous materials 9 are introduced in the interior space of the bulb body 5*a*, the hollow pipe 8 is removed, and the portion communicating with the hollow pipe 8, of the bulb body 5*a* is covered. In this process, as shown in FIG. 3, a protrusion 5*c* is formed on the covered portion of the bulb body 5*a*.

However, the bulb of the conventional electrodeless lighting system having such a structure has the following problems. Because the protrusion remains at the bulb portion in the manufacturing process, part of light passes through the protrusion and is refracted thereby when light is emitted from the bulb to the outside. For this reason, the light distribution characteristic of the entire electrodeless lighting system is degraded, and its appearance does not look fine.

SUMMARY OF THE INVENTION

Therefore, an object of the present invention is to provide a bulb structure and a manufacturing method of an electrodeless lighting system configured to improve light distribution characteristics.

To achieve these and other advantages and in accordance with the purpose of the present invention, as embodied and broadly described herein, there is provided a bulb structure of an electrodeless lighting system comprising: a bulb body having an interior space receiving a luminous material emitting light by microwave energy; a bulb support portion integrally extending from one side of the bulb body to communicate with the bulb body, supporting the bulb body, connected to a bulb rotating motor at its one end, and having therein a passage through which the luminous material is injected; and a covering portion formed at an inner communicating portion of the bulb body and the bulb support portion so as to hermetically seal the bulb body.

To achieve these and other advantages and in accordance with the purpose of the present invention, as embodied and broadly described herein, there is provided a bulb manufacturing method of an electrodeless lighting system comprising: a first step of integrally forming a bulb support portion having therein a passage for injection of the luminous material at one side of a bulb body having an interior space receiving a luminous material emitting light by microwave energy, the bulb support portion communicating with the bulb body; a second step of injecting the luminous material in the interior space of the bulb body through an injection passage of the bulb support portion; and a third step of forming a covering portion at an inner communicating portion where the bulb body communicates with the bulb support portion so that the interior space of the bulb body in which the luminous material is filled is hermetically sealed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a bulb of an electrodeless lighting system in accordance with the present invention, and hereinafter, the most preferred embodiment will be explained.

Figure 1:
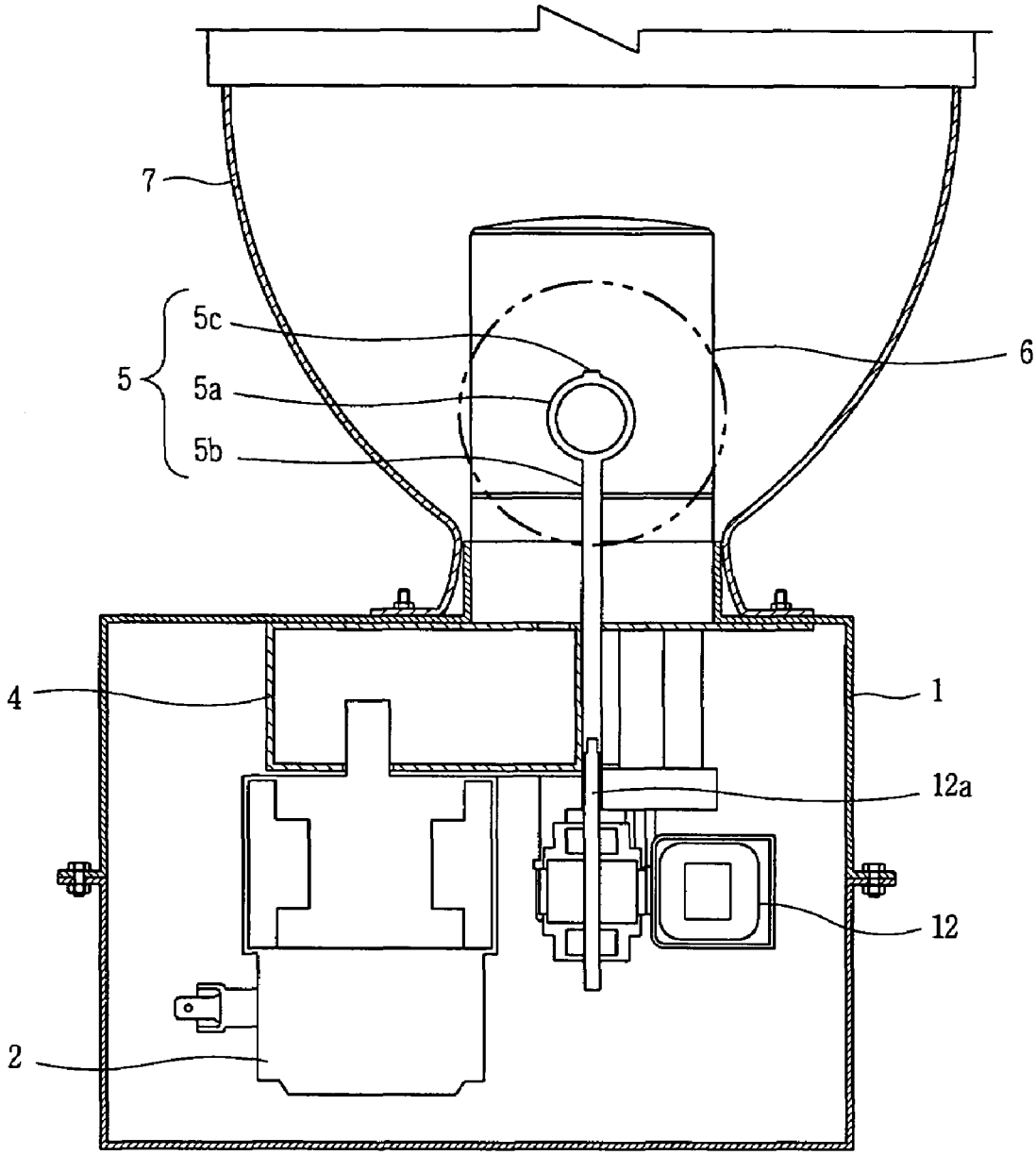
FIG. 1 is a longitudinal sectional view showing a conventional electrodeless lighting system.
Figure 2:
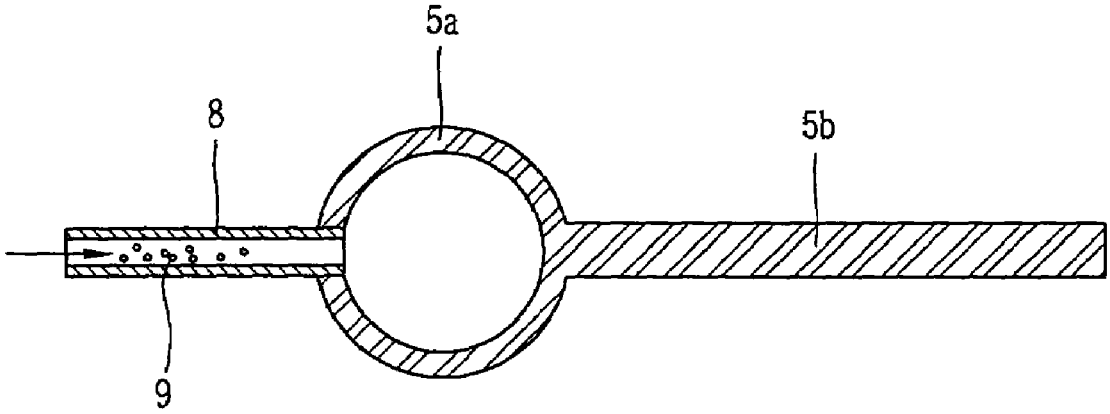
FIG. 2 is a sectional view showing a manufacturing method of a bulb of the conventional electrodeless lighting system.
Figure 3:
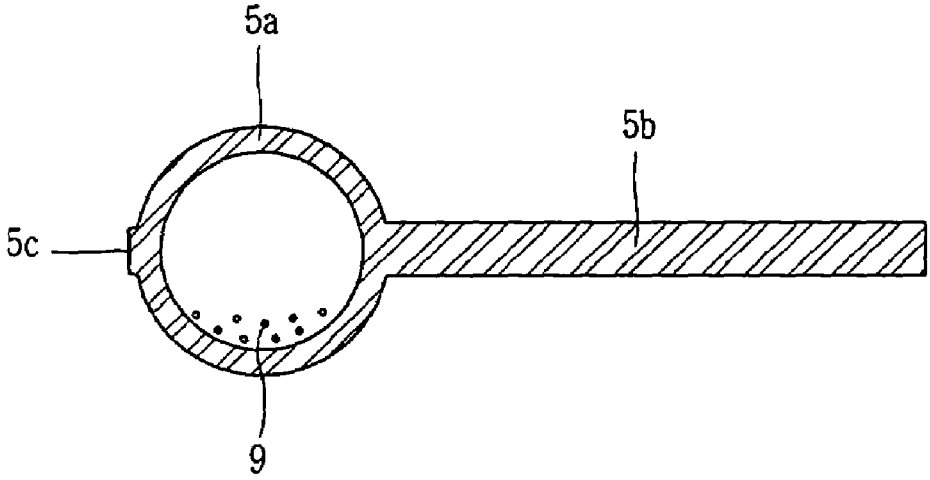
FIG. 3 is a sectional view showing a bulb structure of the conventional electrodeless lighting system.
Figure 4:
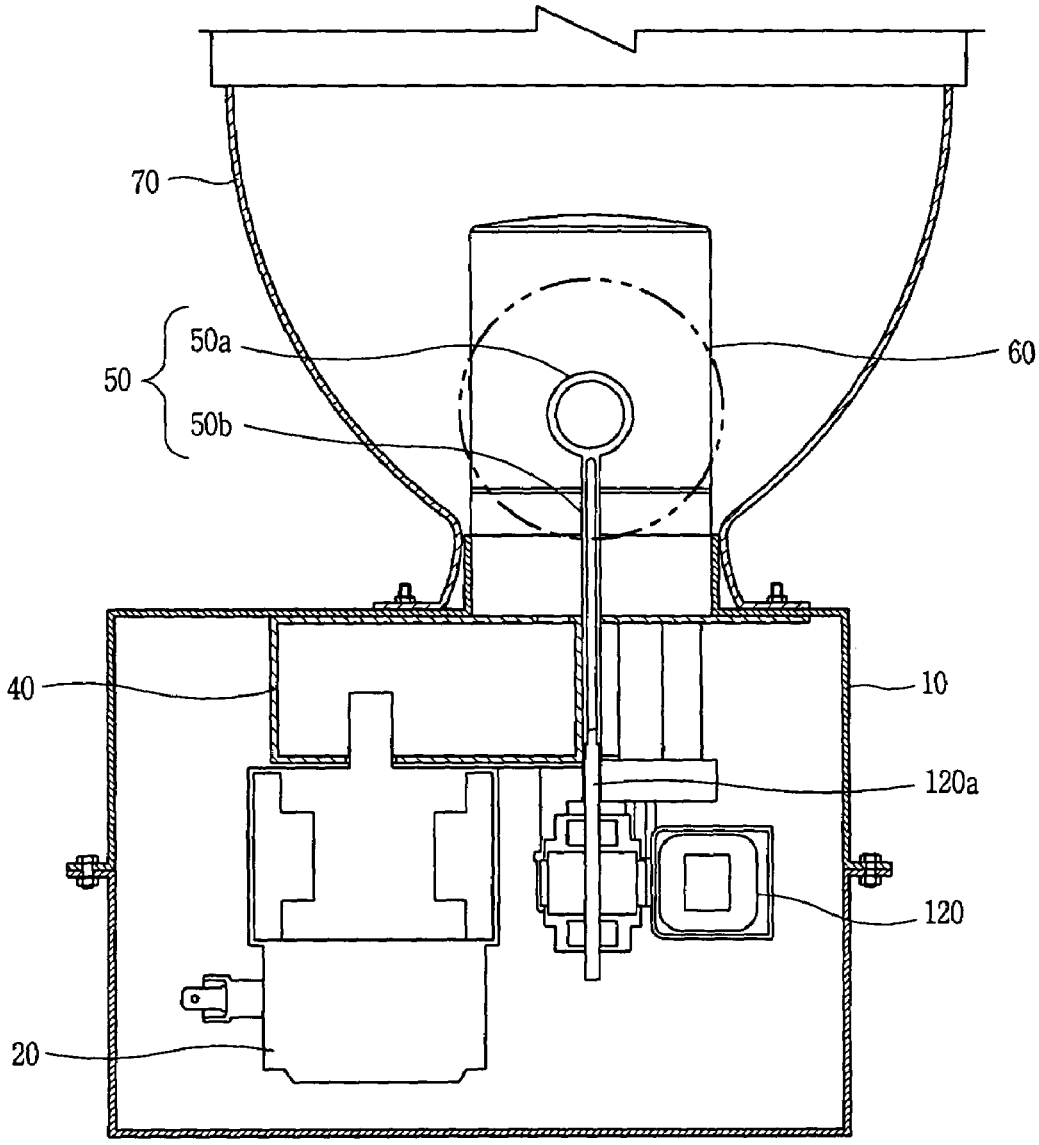
FIG. 4 is a longitudinal sectional view showing an electrodeless lighting system in accordance with one embodiment of the present invention.
Figure 5:
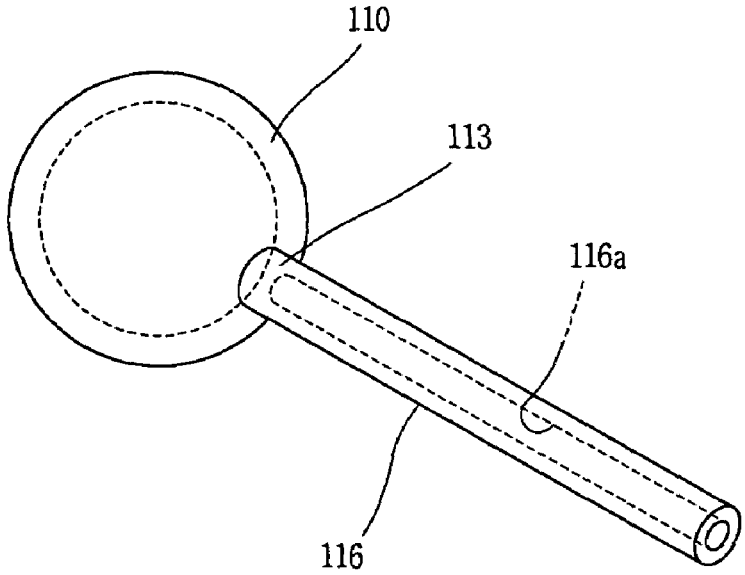
FIG. 5 is a perspective view showing a bulb of the electrodeless lighting system in accordance with one embodiment of the present invention.
Figure 6:
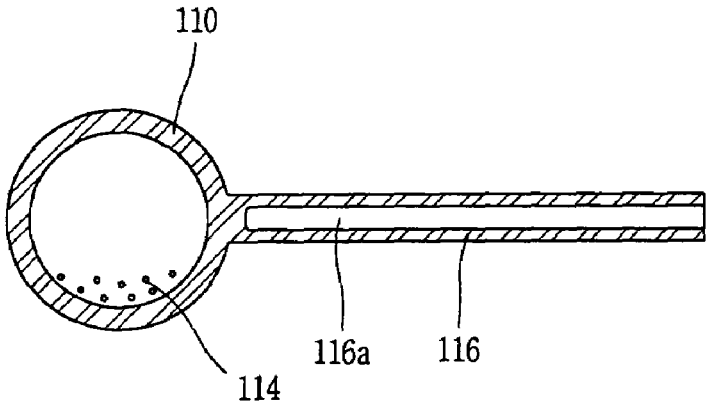
FIG. 6 is a longitudinal sectional view of FIG. 5.

FIG. 4 shows an electrodeless lighting system in accordance with one embodiment of the present invention, and FIGS. 5 and 6 show a bulb structure of the electrodeless lighting system in accordance with one embodiment of the present invention.

As shown, the electrodeless lighting system in accordance with one embodiment of the present invention includes: a case 10 forming a certain interior space; a microwave generator 20 mounted in the case 10, for generating microwave energy; a waveguide 40 for guiding microwave energy generated at the microwave generator 20; a resonator 60 installed, communicating with the waveguide 40; and a bulb 50 positioned in the resonator 60, for generating light as a luminous material 114 filled therein becomes a plasma by microwave energy transferred through the waveguide 40.

In addition, a reflecting mirror 70 for concentratively reflecting light generated at the bulb 60 to the front is provided in front of the case 10, namely at a surrounding area of the resonator 60.

Undescribed reference mark 120 is a bulb rotating motor for rotating the bulb 5, and 120*a* is a bulb motor rotating shaft.

The bulb 50 includes: a bulb body 110 having an interior space receiving a luminous material 114 emitting light by microwave energy; a bulb support portion 116 integrally extending from one side of the bulb body 110 to communicate with the bulb body 110, supporting the bulb body 110, connected to the bulb rotating motor 120 at its one end, and having therein a passage 116*a* through which the luminous material 114 is injected; and a cover portion 113 formed at an inner communicating portion 112 where the bulb body 110 and the bulb support portion 116 communicate with each other, for hermetically sealing the bulb body 110.

The bulb body 110 is formed as a spherical shape whose surface is sleek except a portion connected to the bulb support portion 116.

Preferably, the bulb support portion 116 is formed as a hollow pipe shape having a through hole which becomes an injection passage 116*a* of the luminous material 114 at its central portion in a longitudinal direction, so that the luminous material 114 is injected and received easily in the interior space of the bulb body 110.

Also, the cover portion 113 is formed at the inner communicating portion 112 where the bulb body 110 and the bulb support portion 116 communicate with each other in order to prevent the luminous material 114 received in the interior space of the bulb body 110 from being leaked to the outside through the passage 116*a* of the bulb support portion 116. At this time, the cover portion 113 is formed by welding the inner communicating portion 112 of the bulb body 110 and the bulb support portion 116.

Figure 9:
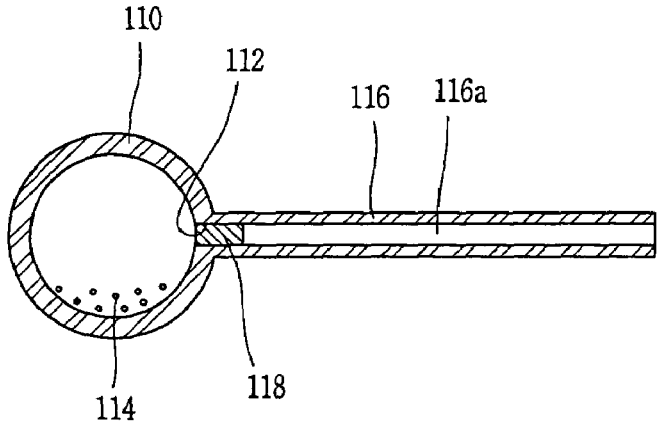
FIG. 9 is a longitudinal sectional view showing a bulb structure in accordance with another embodiment of the present invention.

Also, like a bulb structure in accordance with another embodiment shown in FIG. 9, the communicating portion 112 can be covered by a covering member 120 inserted through the injection passage 116*a* of the bulb support portion 116.

At this time, the covering member 120 is preferably fitted to the communicating portion 112 by a forced fit method. However, the covering member 120 may be fitted thereto by other covering methods besides the forced fit method.

Figure 7:
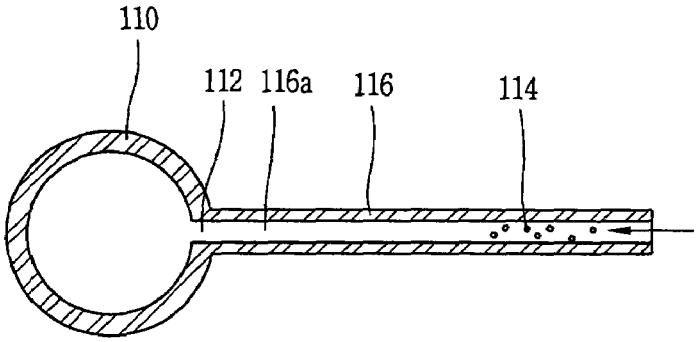
FIGS. 7 and 8 are longitudinal sectional views showing a manufacturing process of the bulb in accordance with one embodiment of the present invention.
Figure 8:
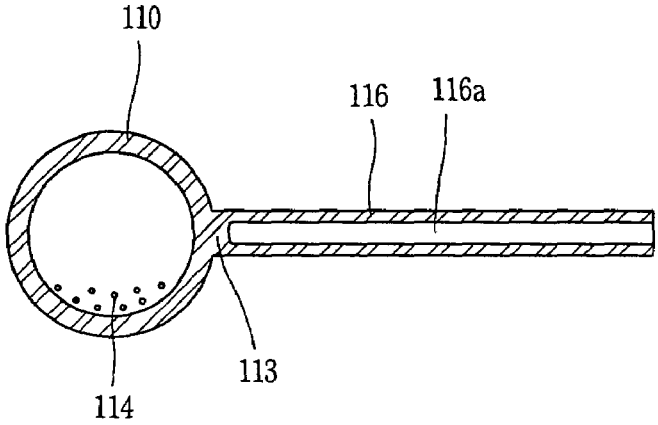

FIGS. 7 and 8 show a bulb manufacturing method of the electrodeless lighting system in accordance with one embodiment of the present invention.

As shown, the bulb manufacturing method of the electrodeless lighting system in accordance with one embodiment of the present invention includes: a first step of integrally forming a bulb support portion 116 having therein a passage 116*a* through which a luminous material emitting light by microwave energy is injected at one side of a bulb body 110 having an interior space receiving the luminous material 114, the bulb support portion communicating with the bulb body 110; a second step of injecting the luminous material 114 in the interior space of the bulb body 110 through the injection passage 116*a* of the bulb support portion 116; and a third step of forming a covering portion 113 at an inner communicating portion 112 where the bulb body 110 communicates with the bulb support portion 110 so that the interior space of the bulb body 110 having received the luminous material 114 is hermetically sealed.

In third step, the covering portion 113 is preferably formed by welding the inner communicating portion 112 of the bulb body 110 and the bulb support body 116. However, like another embodiment of the present invention described above, the communicating portion 112 may be closed by a covering member 118 inserted through the injection passage 116*a* of the bulb support portion 116.

It is preferable to fit the covering member 118 to the communicating portion 112 by a forced fit method, but the covering member 120 may be fitted thereto by other methods besides the forced fit method.

As so far described, the bulb of the electrodeless lighting system in accordance with the present invention is formed in such a manner that a bulb support portion supporting a spherical bulb body and having therein a passage for injection of a luminous material into the bulb body is integrally formed at one side of the bulb body, communicating therewith, a luminous material is received in an interior space of the bulb body through the injection passage of the bulb support portion, and then a communicating portion of the bulb body and the bulb support portion is covered. Thus, a protrusion resulted from the sealing of an interior space of the bulb in which a luminous material is filled does not remain at a surface of the bulb body. Accordingly, unlike the conventional art, refraction of light due to the protrusion does not occur in the present invention, so that light distribution characteristics of the electrodeless lighting system can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A bulb structure of an electrodeless lighting system, comprising:

a bulb body having an interior space which receives a luminous material which emits light when microwave energy is applied thereto;

a bulb support portion integrally extending from one side of the bulb body which supports the bulb body, connects to a bulb rotating motor, and includes therein a passage through which the luminous material is injected;

a covering portion provided at an end of a communicating portion where the bulb body communicates with the bulb support portion, so as to hermetically seal the bulb body, the covering portion comprising a covering member configured for insertion through the passage of the bulb support portion; and a reflector formed independently of the bulb body, the reflector installed about the bulb body and configured to reflect the light emitted from the bulb body.

2. The bulb structure of claim 1, wherein the covering member is fitted to the communicating portion by a force fit method.

3. The bulb structure of claim 1, wherein the bulb support portion has a hollow pipe shape.

4. A method of manufacturing a bulb of an electrodeless lighting system, comprising:

integrally forming a bulb support portion having therein a passage for injection of a luminous material at one side of a bulb body having an interior space which receives the luminous material, the luminous material emitting light when microwave energy is applied thereto, the bulb support portion and bulb body being formed independently of a reflector configured to reflect light emitted by the luminous material;

injecting the luminous material into the interior space of the bulb body through the passage of the bulb support portion; and forming a covering portion at an end of a communicating portion where the bulb body communicates with the bulb support portion so that the interior space of the bulb body in which the luminous material is received is hermetically sealed, by inserting a cover member through the passage of the bulb support portion.

5. The method of claim 4, wherein the covering member is fitted to the communicating portion by a force fit method.

6. The method of claim 4, wherein the bulb support portion is configured to connect to a bulb rotating motor.

7. A bulb structure for an electrodeless lighting system, the bulb structure comprising:

a bulb body having an interior space which receives a luminous material which emits light upon application of microwave energy to the luminous material;

a bulb support portion integrally extending from one side of the bulb body, the bulb support portion being configured to support the bulb body and for connection to a bulb rotating motor, the bulb support portion including a passage through which the luminous material is injected into the bulb body, wherein the bulb body communicates with the bulb support portion through a communicating portion; and a covering portion provided at an end of the communicating portion so as to hermetically seal the bulb body, the bulb support portion and the communicating portion having substantially equal diameters.

8. The bulb structure of claim 7, wherein the covering portion is formed by welding the communicating portion of the bulb body and the bulb support portion.

9. The bulb structure according to claim 7, further comprising a reflector independent of the bulb body, the reflector being installed about the bulb body and configured to reflect the light emitted from the bulb body.

10. The bulb structure according to claim 7, wherein the communicating portion is covered by a covering member configured to be inserted through the passage of the bulb support portion.

11. The bulb structure according to claim 10, wherein the covering member is fitted to the communicating portion by a force fit.

12. The bulb structure according to claim 7, wherein the bulb support portion comprises a hollow pipe.

* * * * *